US010066460B2

(12) United States Patent
Pedersen et al.

(10) Patent No.: US 10,066,460 B2
(45) Date of Patent: Sep. 4, 2018

(54) DOWNHOLE FAST-ACTING SHUT-IN VALVE SYSTEM

(76) Inventors: Dag Pedersen, Narvik (NO); Robin Lovslett, Narvik (NO); Tore Vedal, Bardu (NO); Hadi Hajjar, Abu Dhabi (AE)

( * ) Notice: Subject to any disclaimer, the term of this patent is extended or adjusted under 35 U.S.C. 154(b) by 858 days.

(21) Appl. No.: 14/111,312

(22) PCT Filed: Apr. 13, 2012

(86) PCT No.: PCT/EP2012/056785

§ 371 (c)(1),
(2), (4) Date: Oct. 20, 2014

(87) PCT Pub. No.: WO2012/140200

PCT Pub. Date: Oct. 18, 2012

(65) Prior Publication Data

US 2015/0096742 A1 Apr. 9, 2015

(30) Foreign Application Priority Data

Apr. 15, 2011 (GB) ..... 1106399.7

(51) Int. Cl.
*E21B 34/06* (2006.01)
*E21B 34/14* (2006.01)
(Continued)

(52) U.S. Cl.
CPC ..... *E21B 34/14* (2013.01); *E21B 21/103* (2013.01); *E21B 33/124* (2013.01); *E21B 34/06* (2013.01);
(Continued)

(58) Field of Classification Search
CPC ..... E21B 34/14; E21B 34/06
See application file for complete search history.

(56) References Cited

U.S. PATENT DOCUMENTS 4,629,002 A * 12/1986 Pringle ..... E21B 34/101 166/324
4,846,272 A * 7/1989 Leggett ..... E21B 34/063 166/126
(Continued)

FOREIGN PATENT DOCUMENTS

GB 2121084 A 12/1983

OTHER PUBLICATIONS

International Preliminary Report on Patentability and Written Opinion for International Application No. PCT/EP2012/056785 dated Oct. 15, 2013 (8 pages).
(Continued)

*Primary Examiner* — Cathleen R Hutchins
*Assistant Examiner* — Ronald R Runyan
(74) *Attorney, Agent, or Firm* — Finnegan, Henderson, Farabow, Garrett & Dunner LLP

(57) ABSTRACT

A shut-in valve tool for use in a well has a tool body defining a flow path for the flow of well fluid from outside the tool through the tool body to another part of the well. The tool has an inlet port defined in the tool body through which well fluid must flow to enter the flow path. The tool has a sliding valve member located within the tool body and moveable between a first position in which the inlet port is open, and a second position in which the inlet port is blocked. The tool has a supply of compressed fluid and an actuating mechanism which uses the compressed fluid for driving the sliding valve member from the first position to the second position.

14 Claims, 2 Drawing Sheets

(51) Int. Cl.

| | |
|---|---|
| ***E21B 21/10*** | (2006.01) |
| ***E21B 33/124*** | (2006.01) |
| ***E21B 47/06*** | (2012.01) |
| ***E21B 47/12*** | (2012.01) |
| *E21B 34/00* | (2006.01) |

(52) U.S. Cl.
CPC ..... *E21B 47/06* (2013.01); *E21B 47/065* (2013.01); *E21B 47/12* (2013.01); *E21B 2034/005* (2013.01); *E21B 2034/007* (2013.01)

(56) References Cited

U.S. PATENT DOCUMENTS

| | | | | |
|---|---|---|---|---|
| 5,188,172 | A | 2/1993 | Blount et al. | |
| 5,234,057 | A | 8/1993 | Schultz et al. | |
| 6,957,699 | B2 | 10/2005 | Feluch et al. | |
| 7,093,674 | B2 * | 8/2006 | Paluch | E21B 7/068 166/250.17 |
| 7,104,226 | B2 * | 9/2006 | Endoh | F01P 3/02 123/271 |
| 7,114,697 | B2 | 10/2006 | Millet et al. | |
| 7,318,478 | B2 * | 1/2008 | Royer | E21B 34/14 166/332.4 |
| 7,552,773 | B2 * | 6/2009 | Wright | E21B 34/10 166/319 |
| 7,823,633 | B2 | 11/2010 | Hartwell | |
| 2010/0012872 | A1 | 1/2010 | Hartwell | |

OTHER PUBLICATIONS

International Search Report for International Application No. PCT/EP2012/056785 dated Jun. 6, 2013 (5 pages).

* cited by examiner

DOWNHOLE FAST-ACTING SHUT-IN VALVE SYSTEM

CROSS-REFERENCE TO RELATED APPLICATIONS

This application is a national stage entry of International Application No. PCT/EP2012/056785, filed Apr. 13, 2012, which claims the benefit of European Patent Application No. 1106399.7, filed Apr. 15, 2011, all of which are incorporated herein by reference in their entireties.

FIELD OF THE INVENTION

This invention relates to a shut-in valve system for use in downhole tools of the type used in oil and gas wells, in particular during testing operations.

BACKGROUND

One form of testing in oil and gas wells can be performed by shut-in measurements. In such tests, an interval of the well is isolated by means of a packer or the like. Fluids are allowed to flow from the formation in the interval and through a conduit to the surface. By closing a valve in the conduit (shut-in), flow is stopped and the pressure of the fluid in the interval builds up until the pressure in the interval balances the pressure in the fluids in the formation, and flow stops. By monitoring the build-up of pressure in the interval after shut-in, properties of the well and formation can be determined.

The speed at which the valve is closed, and the position of the valve in the conduit will have an impact on the pressure build-up after shut-in. In one form of test, known as a drill stem test (DST), the conduit extends from the isolated interval to the surface of the well, where the valve is located. Consequently, the volume of the interval and conduit (drill stem) can be high, leading to a significant storage effect that can have a substantial effect on the pressure build-up after shut-in.

For shut in tools, valve closure times greater than a few seconds can reduce the data fidelity by masking the early time data response and therefore rendering it not possible to discern near wellbore effects and also making it harder to "pick" the initial build up time, which creates an error range on the final buildup analysis.

A number of patents disclose shut-in tools, including: U.S. Pat. No. 5,188,172 which describes a general automatic memory driven shut-in tool; U.S. Pat. No. 6,957,699 describes a fast closing tool which appears to operate using a ball seat valve mechanism; U.S. Pat. No. 7,114,697 which discloses a motor driven actuator trigger and spring driven actuator and well pressure to force the rapid closure; and U.S. Pat. No. 7,823,633 which discloses a system with an inductively coupled link across the valve for data transfer.

This invention aims to provide a valve system that can be configured to operate quickly and that can be implemented in a manner that reduces the effect of the volume of the interval and conduit.

SUMMARY OF INVENTION

This invention provides a shut-in valve tool for use in a well, comprising; a tool body defining a flow path for the flow of well fluid from outside the tool through the tool body to another part of the well; an inlet port defined in the tool body though which well fluid must flow to enter the flow path; a sliding valve member located within the tool body and moveable between a first position in which the inlet port is open, and a second position in which the inlet port is blocked; a supply of compressed fluid; and an actuating mechanism which uses the compressed fluid for driving the sliding valve member from the first position to the second position.

The supply of compressed fluid can comprise a cylinder containing compressed nitrogen.

The actuating mechanism can comprise a normally closed valve connected to the supply of compressed fluid that is operable to admit fluid to the actuating mechanism.

In one embodiment, the actuating mechanism comprises a timer configured to open the valve at a predetermined time. The timer can be located within the supply of the compressed fluid.

In another embodiment, the actuating mechanism comprises a trigger configured to open the valve in response to a predetermined command signal. The trigger can be attached to the tool body and can be responsive to a command signal from the surface.

The actuating mechanism can comprise a piston that slides in a bore in the tool body and is connected to the valve mechanism. In one embodiment, the piston comprises a damping mechanism for reducing loads on the tool on operation of the actuating mechanism.

The valve can comprise first and second spaced sealing members which seal against corresponding sealing surfaces in the tool body when in the second position. In one embodiment, at least one of the sealing surfaces is defined by a replaceable insert in the tool body. The first and second sealing surfaces can be on opposite sides of the inlet.

In one embodiment, one of the sealing members only engages a sealing surface when the valve is in the second position.

The tool can further comprise a pressure equalizing valve operable to equalize pressure on either side of the valve when in the second position. The pressure equalizing valve can comprise ports in the tool body and a sliding valve member moveable between a closed position wherein flow through the ports is prevented and an open position wherein flow through the ports is permitted. The pressure equalizing system can also comprise a formation to be engaged by an operating tool by which the sliding valve member can be moved from the closed position to the open position.

Further aspects of the invention will be apparent from the following description.

DETAILED DESCRIPTION

Figure 1A:
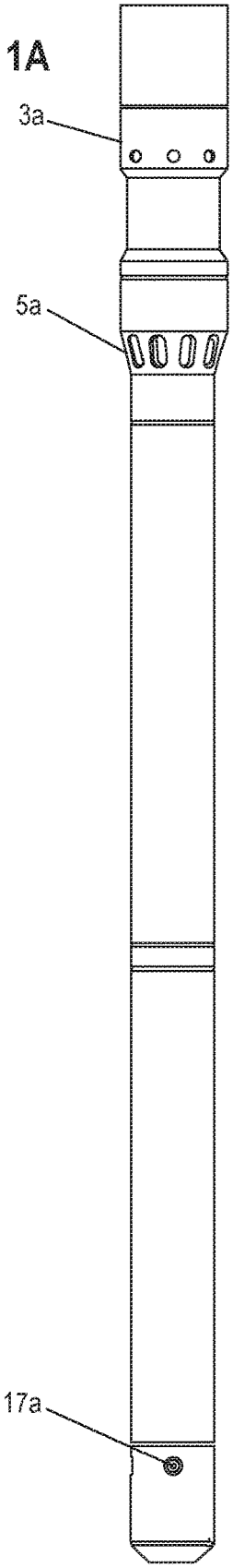
FIGS. 1*a* and 1*b* show side and sectional views of a tool according to one embodiment of the invention.
Figure 1B:
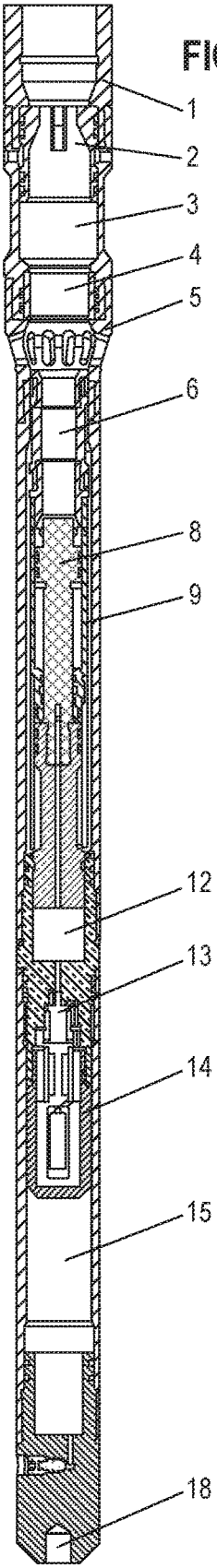
Figure 2A:
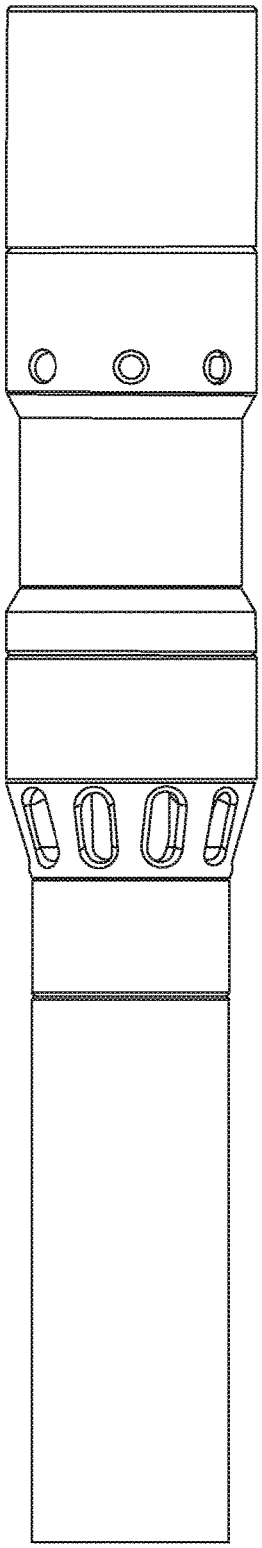
FIGS. 2*a* and 2*b* show detailed views of a part of the tool shown in FIGS. 1*a* and 1*b*.
Figure 2B:
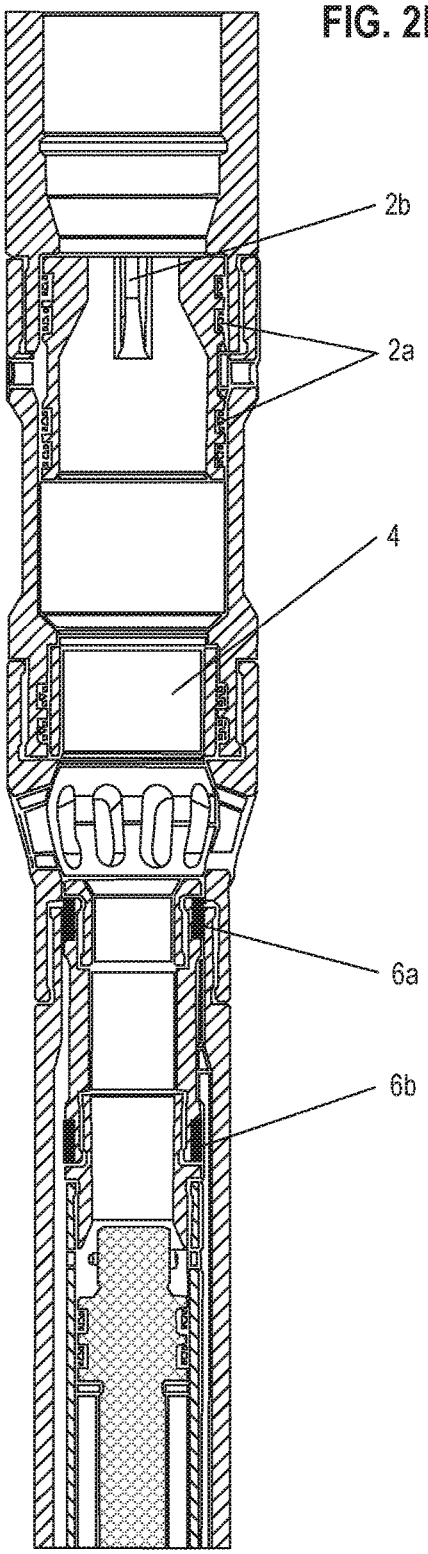

The tool shown in the figures can be installed below a packer such as a retrievable packer that can be used to prevent flow up the well other than through a conduit in the packer. The tool is positioned such that flow of fluid from the interval below the packer must pass through the tool before passing through the packer as will be described below.

The tool shown in the figures comprises a substantially cylindrical tool body 1 that comprises an inlet section 5 including a series of inlet ports 5*a*. A sliding valve system is located within the tool body 1 below the inlet section 5.

The sliding valve system comprises a sliding valve 6 in the form of a cylinder having seals 6*a*, 6*b* around the periphery of the ends thereof. The lower end of the valve 6 is connected to an actuating mechanism by which it can be moved between a first position, as shown in the figures, in which the inlet ports 5*a* are open, and a second position in which the valve member 6 obstructs the inlet ports 5*a* as is described below.

An actuating mechanism comprises a supply 15 of a compressed fluid, such as compressed nitrogen gas at 5000 psi. The supply 15 can be filed via a filling hole 17*a* in the outer surface of the tool body 1. Flow of fluid from the supply 15 is controlled by means of a valve 13 under the control of a timer unit 14 located within the supply 15. Operation of the valve 13 allows fluid to be admitted into a piston section 12 which includes a sliding piston 9. The piston is connected to the valve 6 between the first and second positions. A damper 8 is included so as to limit physical shocks on the tool from operation of the actuating mechanism.

A pressure equalizing section 3 is positioned above the inlet section 5 and comprises pressure equalization holes 3*a* which are normally closed by a slideable equalization valve 2.

A pressure/temperature gauge can be connected to the tool bull nose 18.

In the position shown in the figures, as run into the well, the pressure above and below the piston 9 is substantially balanced. After a predetermined time, the timer unit 14 sends a signal to open the valve 13 and admit the pressurized fluid to the cylinder 12. This has the effect of rapidly driving the piston 9 up the tool body to move the valve 6 into a second position in which the seals 6*a*, 6*b* seal against the inner wall of the tool on either side of the inlet section 5, The upper seal 6*a* seals against an insert ring 4 located above the inlet section 5 and the lower seal 6*b* seals against the inner surfaces of the tool body below the inlet section 5. In this position, no fluid can flow from the outside of the tool through its interior to the upper part of the well.

The energy to achieve a rapid closing action of the valve (on the order of a fraction of a second) can obtained by using nitrogen under pressure (up to 5000 psi) to move the pressure balanced piston 9, that is connected to the valve 6 that rapidly closes the inlet flow ports 5*a*. Flow through the tool can be restored by moving down the equalizing valve 2 with an actuating prong (not shown) after the shut in period is finalized, and allowing flow through the pressure equalizing holes 3*a*. To avoid rapid decompression problems affecting the packer above the tool, the total equalizing flow area may be reduced during equalization by blocking some of the equalizing holes 3*a*.

Pressure balancing of the piston 9 is achieved by a number of holes in the piston section 9. A number of seals are used to prevent well pressure or high pressure nitrogen from entering the piston section 9, 10, in addition two main seals 6*a*, 6*b* which are used for closing the flow ports 5*a*. During movement of the sliding valve 6, all of these seals create a friction force. By using the valve 13 that allows a rapid flow of nitrogen, the piston 9 can be caused to move rapidly as the closing force can be substantially higher than the friction force. To further reduce the starting friction force the lower main seal 6*b* is not engaged during start of the closing the valve 6. A hardened replaceable insert ring 4 can be used as an upper seal area when the valve 6 is closed, as the upper seal 6*a* will be placed directly inside this ring 4. If the gas or oil flowing through the inlet ports 5*a* contains sand or other particles, eventually the around the insert ring 4 will experience erosion damage. By using a simple system for replacing the upper seal area between runs, the risk of leakages during build up can be reduced. After the valve 6 is closed the valve is pressure balanced with respect to internal pressure inside the tool above the packer. The piston 9 and valve 6 are held in the closed position by internal pressure from the nitrogen and the friction force. An additional closing snap ring may be used to keep the piston 9 in closed position (not shown).

The buildup period can be as long as needed to achieve the best possible data. The tool does not have a fixed opening time after build up. To restore circulation, a prong (not shown) is deployed with the purpose of moving down the equalizing valve 2 thus allowing flow from below the packer or from surface into the reservoir. Several seals 2*a* are used for sealing the pressure balanced sleeve 2 from the pressure outside the slam shut tool. During equalizing, a prong is run in hole and passes through the center of the packer (not shown) before it lands on top of the equalizing valve 2. By jarring the valve 2 down, the equalizing holes 3*a* will be exposed, and allow circulation to be restored.

The tool provides a valve system that can be used in high temperatures (up to 200 deg Celsius), and in high concentrations of $H_2S$ (up to 50%) and $CO_2$ (up to 20%). However, it is not restricted to such uses and can be used in any environment.

Various changes can be made within the scope of the invention. For example, activating the valve 13 may also be initiated using an external signal by using a trigger system attached to the bull nose 18.

The invention claimed is:

1. A shut-in valve tool for use in a well, comprising;

a tool body defining a flow path for the flow of well fluid from outside the tool through the tool body to another part of the well;

an inlet port defined in the tool body through which well fluid must flow to enter the flow path;

a first valve comprising a sliding valve member located within the tool body and moveable between an initial first position in which the inlet port is open, and a second position in which the inlet port is blocked, wherein the sliding valve member in the first position is positioned below the inlet port;

a supply of compressed fluid; and an actuating mechanism which uses a flow of the compressed fluid for driving the sliding valve member from the initial first position to the second position, wherein the actuating mechanism comprises a piston that slides in a bore in the tool body and is connected to the sliding valve member, the bore is separate from the supply, and wherein the actuating mechanism further comprises a normally closed second valve connected between the supply of compressed fluid and the piston, the normally closed second valve being operable to admit a flow of the compressed fluid from the supply of compressed fluid to the piston to drive the sliding valve member from the first position to the second position within a fraction of a second.

2. A tool as claimed in claim 1, wherein the supply of compressed fluid comprises a cylinder containing compressed nitrogen.

3. A tool as claimed in claim 1, wherein the actuating mechanism comprises a timer configured to open the second valve at a predetermined time.

4. A tool as claimed in claim 3, wherein the timer is located within the supply of the compressed fluid.

5. A tool as claimed in claim 1, wherein the actuating mechanism comprises a trigger configured to open the second valve in response to a predetermined command signal.

6. A tool as claimed in claim 5, wherein the trigger is attached to the tool body.

7. A tool as claimed in claim 6, wherein the trigger is responsive to a command signal from the surface.

8. A tool as claimed in claim 1, wherein the piston comprises a damping mechanism for reducing loads on the tool on operation of the actuating mechanism.

9. A tool as claimed in claim 1, wherein the first valve comprises first and second spaced sealing members which seal against corresponding sealing surfaces in the tool body when in the second position.

10. A tool as claimed in claim 9, wherein at least one of the sealing surfaces is defined by a replaceable insert in the tool body.

11. A tool as claimed in claim 9, wherein the first and second sealing surfaces are on opposite sides of the inlet.

12. A tool as claimed in claim 9, wherein one of the sealing members only engages a sealing surface when the valve is in the second position.

13. A tool as claimed in claim 1, further comprising a pressure equalizing valve operable to equalize pressure on either side of the first valve when the first valve is in the second position.

14. A system for measuring pressure build up in a well comprising:

a retrievable packer, a pressure gauge, a shut-in valve tool configured to be positioned below the retrievable packer, the shut-in valve tool comprising:

a tool body defining a flow path for the flow of well fluid from outside the tool through the tool body to another part of the well;

an inlet port defined in the tool body through which well fluid must flow to enter the flow path;

a first valve comprising a sliding valve member located within the tool body and moveable between an initial first position in which the inlet port is open, and a second position in which the inlet port is blocked, wherein the sliding valve member in the first position is positioned below the inlet port;

a supply of compressed fluid; and an actuating mechanism which uses a flow of the compressed fluid for driving the sliding valve member from the initial first position to the second position, wherein the actuating mechanism comprises a piston that slides in a bore in the tool body and is connected to the sliding valve member, the bore is separate from the supply, and wherein the actuating mechanism further comprises a normally closed second valve connected between the supply of compressed fluid and the piston, the normally closed second valve being operable to admit a flow of fluid from the supply of compressed fluid to the piston to drive the sliding valve member from the first position to the second position within a fraction of a second;

wherein the sliding valve member is in the first position when the system is configured to be run into the well.

* * * * *